United States Patent [19]

Taniguchi et al.

[11] Patent Number: 4,792,495

[45] Date of Patent: Dec. 20, 1988

[54] FUSIBLE INK SHEET

[75] Inventors: Makoto Taniguchi; Seiichi Hayashi; Katsumori Takei; Hitoshi Fukushima, all of Nagano, Japan

[73] Assignee: Seiko Epson Corporation, Tokyo, Japan

[21] Appl. No.: 854,649

[22] Filed: Apr. 22, 1986

[30] Foreign Application Priority Data

| | | | |
|---|---|---|---|
| Apr. 22, 1985 | [JP] | Japan | 60-85666 |
| May 23, 1985 | [JP] | Japan | 60-111258 |
| Jun. 14, 1985 | [JP] | Japan | 60-129554 |
| Jun. 19, 1985 | [JP] | Japan | 60-133631 |

[51] Int. Cl.[4] ..... B41M 5/26

[52] U.S. Cl. ..... 428/484; 428/195; 428/212; 428/488.4; 428/500; 428/914; 428/913

[58] Field of Search ..... 428/484, 488.1, 488.4, 428/913, 914, 195, 212, 500

[56] References Cited

U.S. PATENT DOCUMENTS

| | | | |
|---|---|---|---|
| 3,944,695 | 3/1976 | Kosaka et al. | 428/488.1 |

FOREIGN PATENT DOCUMENTS

| | | | |
|---|---|---|---|
| 0154438 | 9/1985 | European Pat. Off. | 428/488.4 |
| 3507097 | 9/1985 | Fed. Rep. of Germany | 428/488.4 |
| 0030892 | 3/1981 | Japan | 428/488.1 |
| 0109389 | 6/1984 | Japan | 428/488.4 |

*Primary Examiner*—Bruce H. Hess
*Attorney, Agent, or Firm*—Blum Kaplan

[57] ABSTRACT

A fusible ink sheet having a top layer of carnauba wax and ethylene vinyl acetate copolymer on a color layer is provided. The fusible ink sheet is superior in blocking resistance, capable of transfer with a low level of transfer energy and suitable for full color printing. In other embodiments, the carnauba wax is used in combination with specific montan wax or paraffin wax.

13 Claims, 23 Drawing Sheets

TRANSFER ENERGY (CYAN)

| | A | B | C | D | E | F | G | H | I | J | K | L | M | N | O | P |
|---|---|---|---|---|---|---|---|---|---|---|---|---|---|---|---|---|
| TRANSFER ENERGY | 10/16 | 20/16 | 30/16 | 40/16 | 50/16 | 60/16 | 70/16 | 80/16 | 90/16 | 100/16 | 110/16 | 120/16 | 130/16 | 140/16 | 150/16 | 160/16 |

TRANSFER ENERGY (MAGENTA) ; 160/16 (mJ)

UNIT ; (mJ)

CARNAUBA WAX DSC

APPARATUS: THERMOANALYSIS SYSTEM: MODEL SSC580
DSC MODULE: MODEL DSC20
MADE BY SEIKO DENSHI KOGYO CO. LTD.

AMOUNT OF SAMPLE: 12.05 mg

PAN: 35 mg (Al)

RANGE OF TEMPERATURE MEASURED: -20°C TO 180°C

RANGE OF TEMPERATURE RISE: 10°C/MIN.

GAS AND FLOW RATE: NITROGEN, 25 ml/MIN.

PARAFFIN WAX DSC

APPARATUS: THERMOANALYSIS SYSTEM: MODEL SSC 580
DSC MODULE: MODEL DSC 20
MADE BY SEIKO DENSHI KOGYO CO., LTD.

AMOUNT OF SAMPLE: 12.42 mg

PAN: 35 mg (Al)

RANGE OF TEMPERATURE MEASURED: -20°C TO 180°C

RANGE OF TEMPERATURE RISE: 10°C/MIN.

GAS AND FLOW RATE: NITROGEN, 25 ml/MIN.

FIG. 9

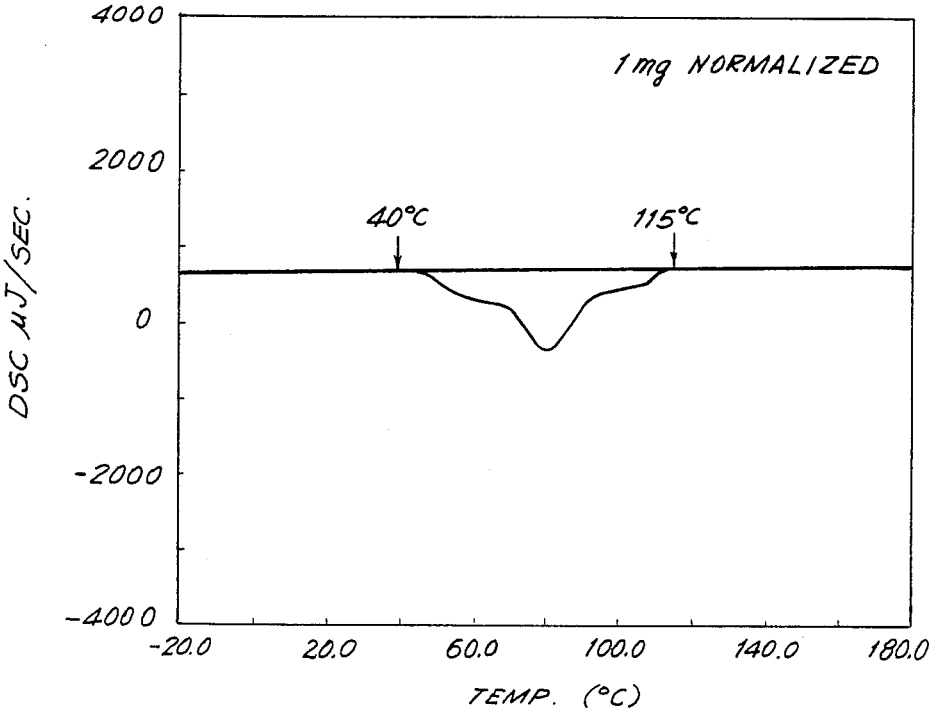

MONTAN WAX, OXIDIZED TYPE, DSC

APPARATUS : THERMOANALYSIS SYSTEM: MODEL SSC580
DSC MODULE : MODEL DSC 20
MADE BY SEIKO DENSHI KOGYO CO., LTD.

AMOUNT OF SAMPLE : 11.85 mg

PAN : 35 mg (Al)

RANGE OF TEMPERATURE MEASURED: -20°C TO 180°C

RANGE OF TEMPERATURE RISE : 10°C/MIN.

GAS AND FLOW RATE : NITROGEN, 25 ml/MIN.

MONTAN WAX, OXIDIZED TYPE: A PRODUCT OF HOECHST CO., LTD.
PARTLY SAPONIFIED, ESTER-MODIFIED WAX, HAVING A MOLECULAR WEIGHT OF ABOUT 800

FUSIBLE INK SHEET

BACKGROUND OF THE INVENTION

This invention relates to fusible ink sheets and, in particular, to fusible ink sheets for use in heat transfer printing.

A fusible ink sheet includes at least a substrate having at least a heat transfer ink disposed thereon. Suitable substrates include uniform resin substrates such as, for example, polyethyleneterephthalate resin and the like. Fusible ink sheets are used for heat transfer printing.

Heat transfer printing is widely used in fascimile machines, recorders and printers because of its many advantages. It is of the non-impact type and is quiet and inexpensive. Heat transfer printing can be accomplished using a small, lightweight apparatus. Additionally, it can be used to perform color printing.

A variety of heat transfer inks for fusible ink sheets have been proposed and are in use. A common requirement is that such inks must undergo phase changes, namely solid to liquid to solid in a short period of time when heat is applied. Since wax meets this requirement, heat transfer inks are often prepared by dispersing a coloring material, such as a pigment and/or a dye in a natural or synthetic wax composed primarily of hydrocarbons. Usually, small amounts of synthetic resin, plasticizer and dispersant are added in order to strengthen the wax and improve the adhesion between the ink and the substrate.

Because the ink is a mixture of wax and resin which softens and melts on heating, conventional fusible ink sheets are disadvantageous in that they are prone to blocking. Blocking refers to the undesirable adhesion between the ink layer and the substrate when the transfer sheet is wound with the layers disposed on top of each other as shown in FIGS. 1 and 2 when ink layer 103 contacts the reverse side of substrate 102 at elevated temperatures.

Blocking causes many problems. For example, when a thermal head is used for printing, blocking causes the ink to stick to the head and lowers transfer efficiency. When ink transfer is performed by applying an electric current to the fusible ink sheet, blocking increases the resistance thereby hindering transfer of ink to a transfer medium in an extreme case. Moreover, blocking makes it difficult to control the transfer density and tone of the transferred ink in full color printing.

Several methods for overcoming the blocking problem have been proposed. For example, blocking can be prevented by using a wax having a higher melting point than a conventional wax. A high melting point wax is less likely to cause blocking than a wax having a low melting point. However, high melting point waxes exhibit poor transfer efficiency. Therefore, in order to compensate for lower transfer efficiency, it is necessary to increase the print energy. This in turn decreases the life of the thermal or electrothermal transfer head.

Another proposed method for preventing blocking is to provide a transfer sheet with a release layer 301 as shown in FIG. 3. Use of release layer 301 does not solve the problem. The fusible ink sheets stick to each other. Additionally, the amount of wax present is reduced as a result of the presence of release layer 301. A release layer is generally between about 0.2 and 2 $\mu$m thick and lowers heat transfer efficiency. Additionally, release layers can only be used in systems having thermal transfer heads and can not be used in systems having electrothermal transfer heads. Furthermore, the blocking problem is not completely eliminated.

In order to attempt to overcome these problems, heat transfer printers are being improved so that it is possible to produce printed images in full color. Some of the recommended systems use the dither method or the area gradation method. A common problem encountered when using these methods is that the optical density of an ink placed over a previously printed ink is poorer than the optical density of ink deposited on plain transfer paper.

Referring specifically to FIG. 4, when a cyan color 401 was transferred to a transfer paper 404 at varying energy levels ranging between 20/16 to 160/16 mJ/mm$^2$, the optical density of the transferred cyan color increased proportionally to the amount of transfer energy applied. This result is shown by curve 501 in FIG. 5, which represents optical density as a function of applied transfer energy for cyan colored ink transferred to plain transfer paper. When a magenta color 402 was transferred to transfer paper 404 at an energy level of 160/16 mJ/mm$^2$ and then cyan color 403 was superimposed on magenta color 402 at energy levels ranging between 20/16 and 160/16 mJ/mm$^2$ as shown in FIG. 4, the optical density of the superimposed cyan color was significantly lower than the optical density of the cyan color transferred onto plain transfer paper 404 at corresponding energy levels. The optical density of the cyan imposed on magenta as a function of applied transfer energy is shown by curve 502 in FIG. 5.

The low optical density of the superimposed ink is a serious drawback to full color reproduction, which is achieved by superimposed magenta, cyan and yellow over each other at controlled densities. One proposed method for eliminating this drawback is to add a tackifier to the ink layer. Another proposed method is to select a solid ink having a low melting point. Both of these proposed methods improve the transfer of the second and subsequent ink layers, but they create further problems. For example, addition of a tackifier to the ink makes the ink stickier and induces blocking. The second proposed method melts the first, second and subsequent inks together so that they can be mixed and also promotes blocking.

In summary, conventional fusible ink sheets for heat transfer printing have poor blocking resistance and superimposing performance. Superimposing performance can be improved only at a sacrifice of blocking resistance. Accordingly, it is desireable to provide a fusible ink sheet having improved blocking resistance and good superimposing performance.

SUMMARY OF THE INVENTION

Generally speaking, in accordance with the invention an improved fusible ink sheet for heat transfer printing is provided. The fusible ink sheet includes an ink layer having two components. A top layer including carnauba wax and ethylene vinyl acetate copolymer is disposed on a color layer. The top layer can also include montan wax or paraffin wax. The fusible ink sheet has improved blocking resistance and good superimposing performance.

Accordingly, it is an object of the invention to provide an improved fusible ink sheet for heat transfer printing.

Another object of the invention is to provide a fusible ink sheet having improved blocking resistance.

A further object of the invention is to provide a fusible ink sheet capable of transferring ink at low levels of transfer energy.

Yet another object of the invention is to provide a fusible ink sheet that is suitable for full color printing.

Yet a further object of the invention is to provide an improved fusible ink sheet including an ink layer formed of a top layer of carnauba wax, ethylene vinyl acetate and at least one of montan wax and paraffin wax disposed on a color layer.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

DETAILED DESCRIPTION OF THE DRAWINGS

For a fuller understanding of the invention, reference is had to the following description taken in connection with the accompanying drawings, in which:

FIG. 9 is a DSC thermograph showing melt properties of montan wax;

DETAILED DESCRIPTION OF THE INVENTION

Carnauba wax, montan wax, paraffin wax and ethylene vinyl acetate copolymer used in the top cover layer of the fusible ink sheet of this invention are known substances having application as polishing agents, for example, in automobile polish, release agents, candles and hot melt adhesives, respectively. They are used as the top layer of an ink layer because they have good anti-blocking properties and allow the ink to be superimposed effectively.

Figure 1:
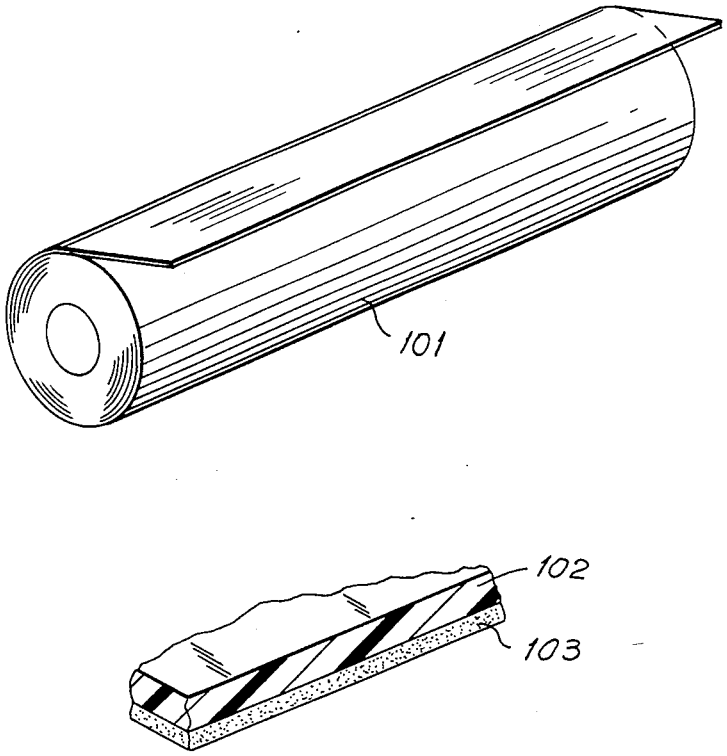
FIG. 1 PRIOR ART
FIG. 1 is a perspective view of a conventional fusible ink sheet roll and an exploded portion of the sheet.
Figure 2:
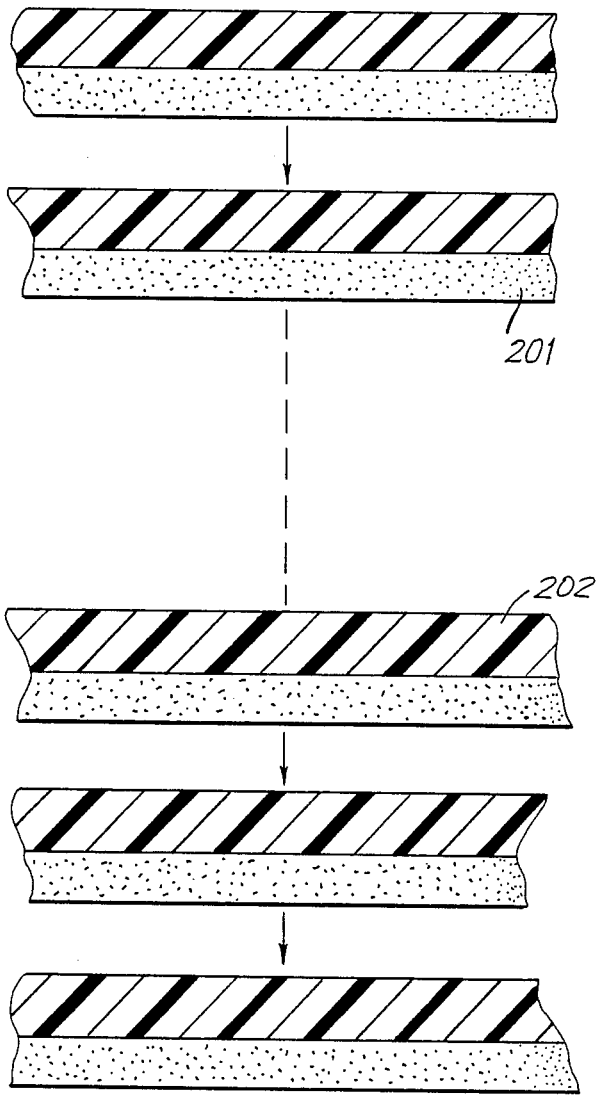
FIG. 2 is an exploded cross-sectional view of a fusible ink transfer sheet when wound as in FIG. 1 showing an ink layer in contact with the substrate.
Figure 3:
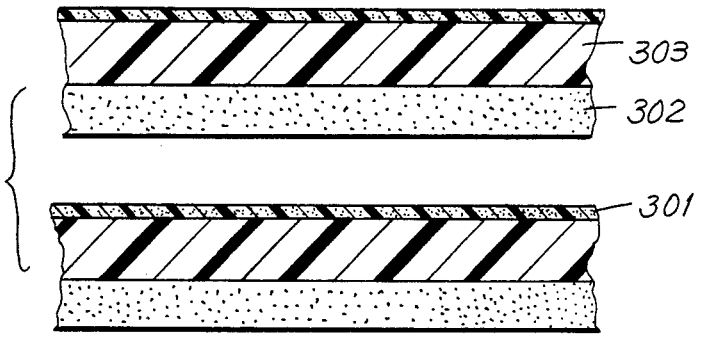
FIG. 3 is a cross-sectional view of a conventional ink sheet including a release layer.
Figure 6:
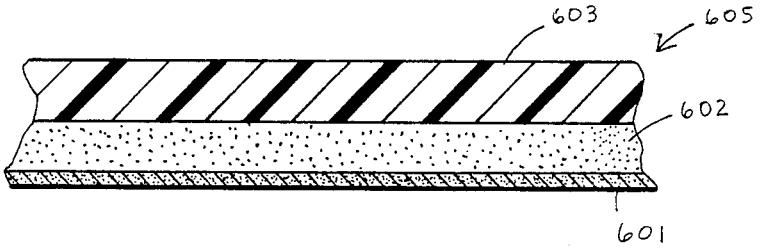
FIG. 6 is a cross-sectional view of a fusible ink sheet including a top layer disposed on the color layer.
Figure 4:
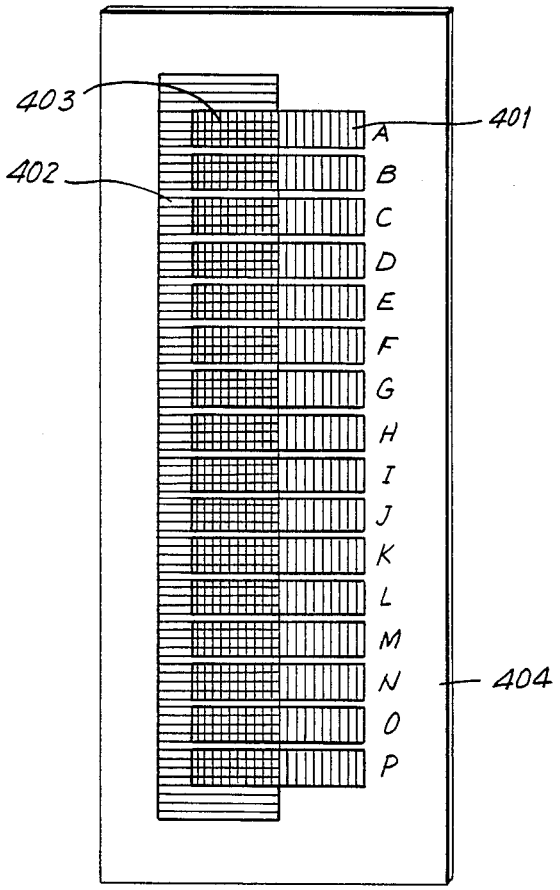
FIG. 4 is a perspective view of a printing pattern used for an ink superimposing test and a chart of the transfer energy applied for each test.
Figure 5:
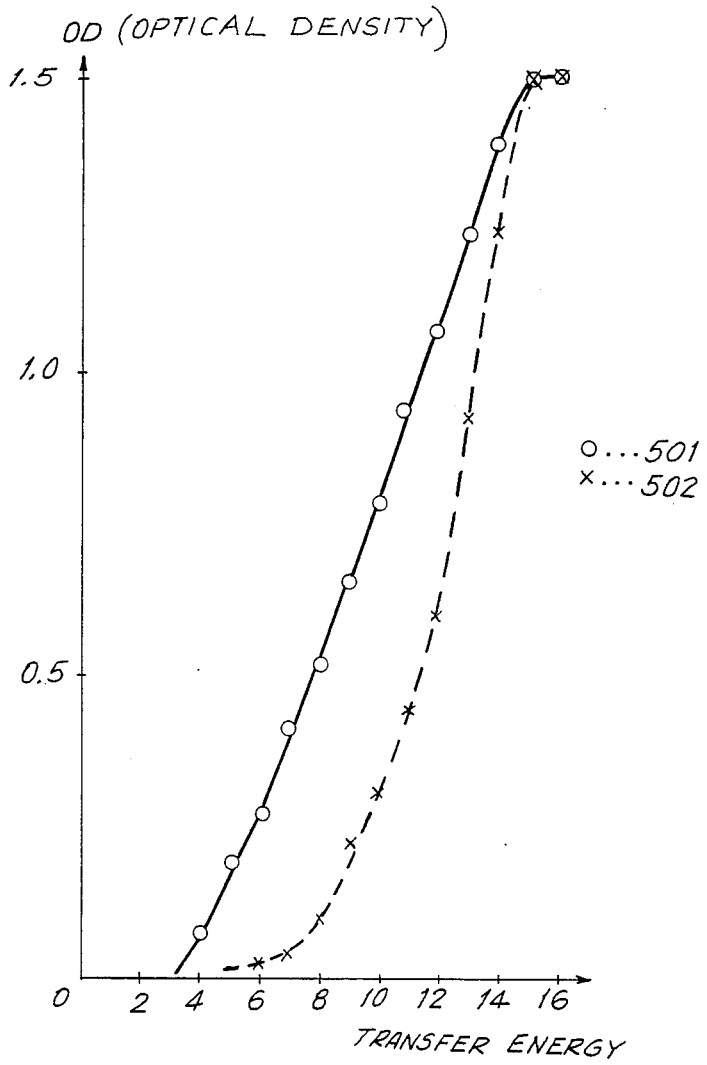
FIG. 5 is a graph showing the relationship between optical density and transfer energy for the test described in the Background.

Referring to FIG. 6, a fusible transfer sheet 605 in accordance with the invention is shown. A color layer 604 includes a layer of fusible ink 602 formed on a substrate 603. Fusible ink 602 is formed by dispersing a pigment in a wax or resin. Suitable pigments or dyes include, for example, carbon black, magenta, cyan and yellow. The fusible ink is of the type used in conventional ink sheets adapted to be used for heat transfer type printing. A top layer 601 is formed on color layer 602. Top layer 601 is transparent or translucent and is formed from at least one of carnauba wax, modified montan wax, paraffin wax, ethylene vinyl acetate copolymer and mixtures thereof.

Figure 7:
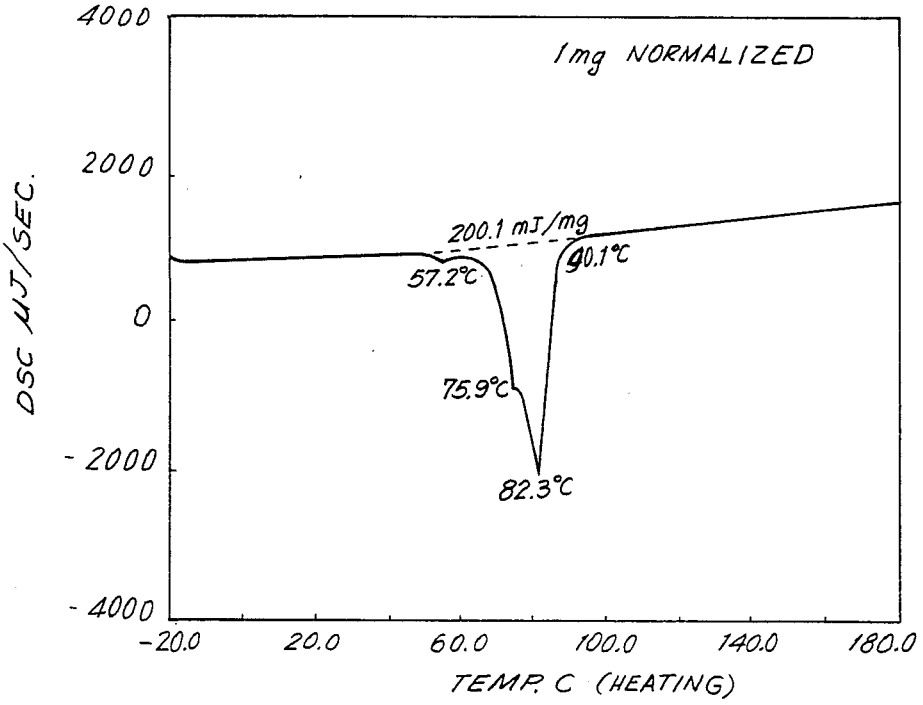
FIG. 7 is a differential scanning calorimetry ("DSC") thermograph showing melt properties of the carnauba wax in the top layer of the fusible ink sheet of FIG. 6.

Carnauba wax utilized in the invention greatly improves the anti-blocking properties of ink layer 602. When carnauba wax is heated gradually, a sharp endothermic change takes place at 82.3° C. This sharp endothermic change makes carnauba wax a useful anti-blocking agent. The endothermic change is due to melting, as shown in the thermograph of FIG. 7. The thermograph was obtained using differential scanning calorimetry (DSC) and will be described in more detail in connection with the Examples.

Figure 8:
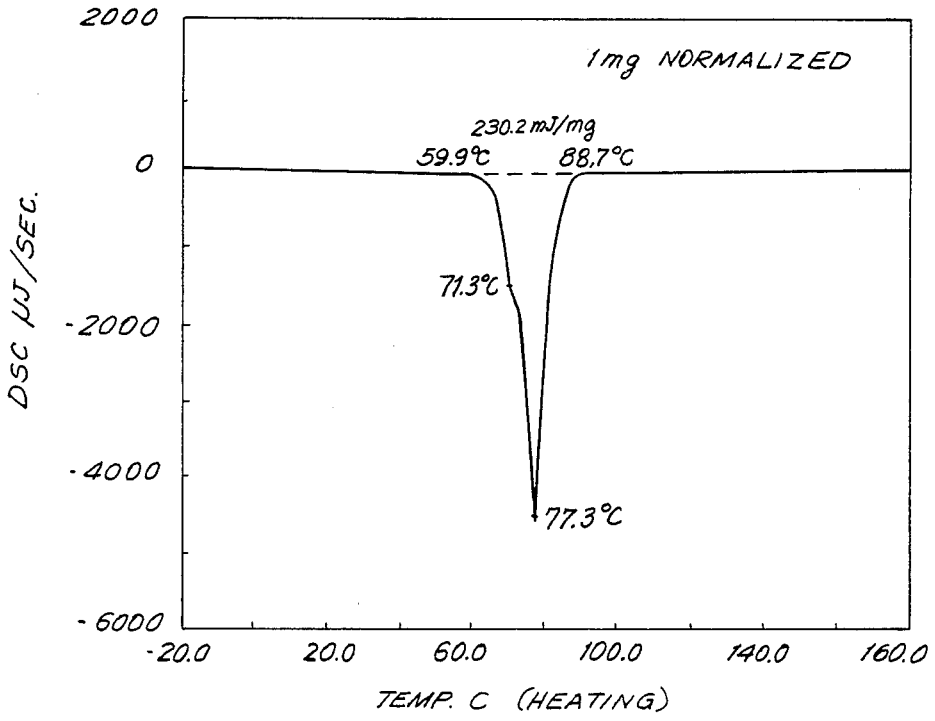
FIG. 8 is a DSC thermograph showing melt properties of paraffin wax.

Paraffin wax utilized in the invention also undergoes a sharp endothermic change at 77.3° C. due to melting, as shown in the thermograph of FIG. 8. There are no endothermic changes due to phase transition take place at temperatures below the peak temperature of 77.3° C. Paraffin wax incorporated into top layer 601 of fusible ink sheet 605 improves the superimposing performance of the ink. In addition, paraffin wax having a single peak also produces an anti-blocking effect. In order to optimize the superimposing performance and the anti-blocking properties, it is desirable to incorporate carnauba wax with paraffin wax in an amount between about 5 and 35 parts by weight of paraffin wax having a single DSC peak between about 65° and 85° C. with between about 95 and 65 parts by weight of carnauba wax.

For modified montan wax, the endothermic change due to melting takes place over a broad temperature range of between about 40° and 115° C., as shown in FIG. 9. This suggests that modified montan wax is a wax systems hving a wide molecular weight distribution. When such modified montan wax is incorporated with carnauba wax for use as a top layer of a fusible ink sheet in accordance with the invention, the superimposing performance of the ink is improved and the optical density of the transferred ink is controllable. The endothermic change over a broad temperature range is generally considered to be disadvantageous in so far as anti-blocking properties are concerned. However, when the modified montan wax is blended with carnauba wax, this is not the case. In order to optimize both the superimposing properties and the anti-blocking properties, it is desirable to incorporate about 5 to 30 parts by weight of oxidized montan wax having a melting point between about 75° and 120° C. into 95 to 70 parts by weight of carnauba wax.

One example of an ethylene vinyl acetate copolymer suitable for use in the top layer of the fusible ink sheet in accordance with the invention has a melt index between about 100 and 900 and contains between about 10 and 30% vinyl acetate. Such a copolymer is referred to as LMI-EVA. LMI-EVA imparts both a cohesive force and an adhesive force and permits the top layer to be transferred to transfer paper. Additionally, LMI-EVA provides flexibility to the top cover layer as well as crack resistance and improved anti-blocking properties. Generally, between about 1 and 15 parts by weight of LMI-EVA per 99 to 85 parts by weight of carnauba wax is included to provide the ink with proper viscosity when it is melted and transferred.

Another type of ethylene vinyl acetate copolymer used in the top layer of the fusible ink sheet in accordance with the invention has a melt index between about 1500 and 3000. This copolymer is referred to as HMI-EVA. The melt viscosity of HMI-EVA is between that of wax and LMI-EVA and functions as a binder which regulates the viscosity according to the mixing ratio of carnauba wax and LMI-EVA. Since the viscosity change of HMI-EVA with temperature is more gradual than the viscosity change of wax, it allows easy density control for gradation. Preferably, between about 5 to 30 parts by weight of HMI-EVA per 95 to 70 parts by weight of carnauba wax are utilized.

The melting point of the components of the top layer is a temperature at which the maximum endothermic change takes place according to a differential scanning calorimetry thermograph measured under the following conditions:

Apparatus: Thermoanalysis system: Model SSC580 DSC module: Model DSC20 made by Seiko Denshi Kogyo Co., Ltd.

Amount of sample: 12±1 mg

Range of temperature measured: −20° C. to 180° C.

Rate of temperature rise: 10° C./min

Range of energy measured: 8000 μJ/sec (normalized to 1 mg)

Gas and flow rate: nitrogen, 25 ml/min

The invention will now be described in more detail with reference to the following examples. These examples are presented for purposes of illustration only and are not intended in a limiting sense. All percentages and parts set forth are by weight based on the total, unless otherwise indicated.

EXAMPLES 1-5 AND COMPARATIVE EXAMPLES 1-3

Figure 10A:
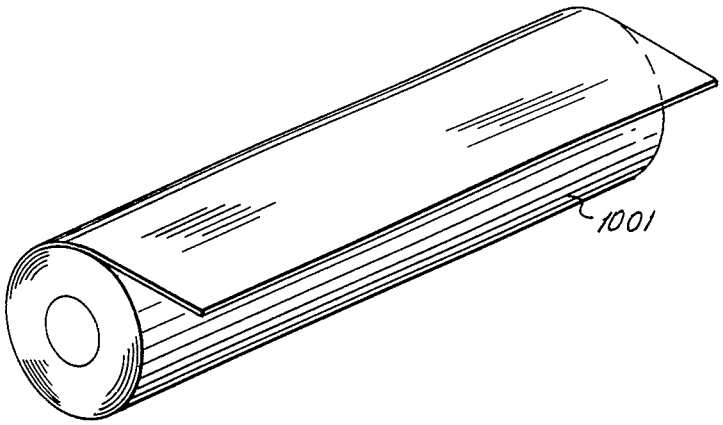
FIG. 10 is a perspective view of a fusible ink sheet and an exploded portion of the sheet showing the layers constructed and arranged in accordance with the invention.
Figure 10B:
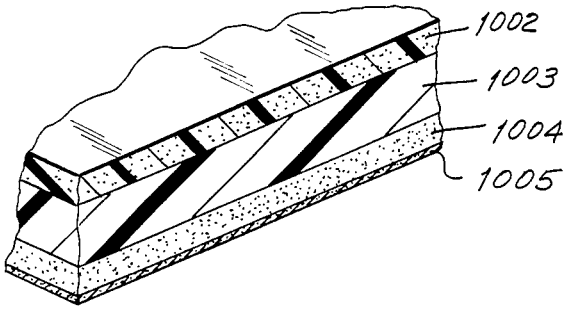
Figure 12:
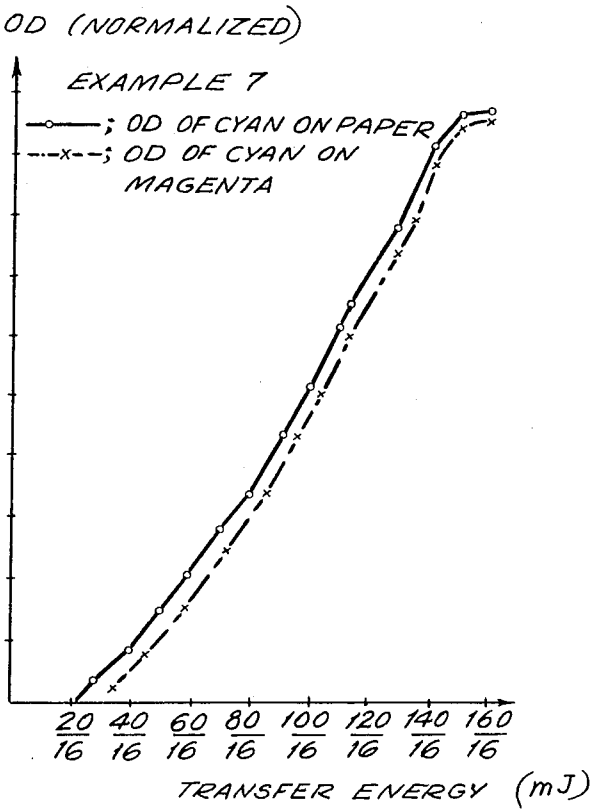
FIGS. 11–37 are graphs showing optical density of transferred ink as a function of transfer energy for the transfer sheet constructions of Examples 1–21 and Comparative Examples 1–14.
Figure 11:
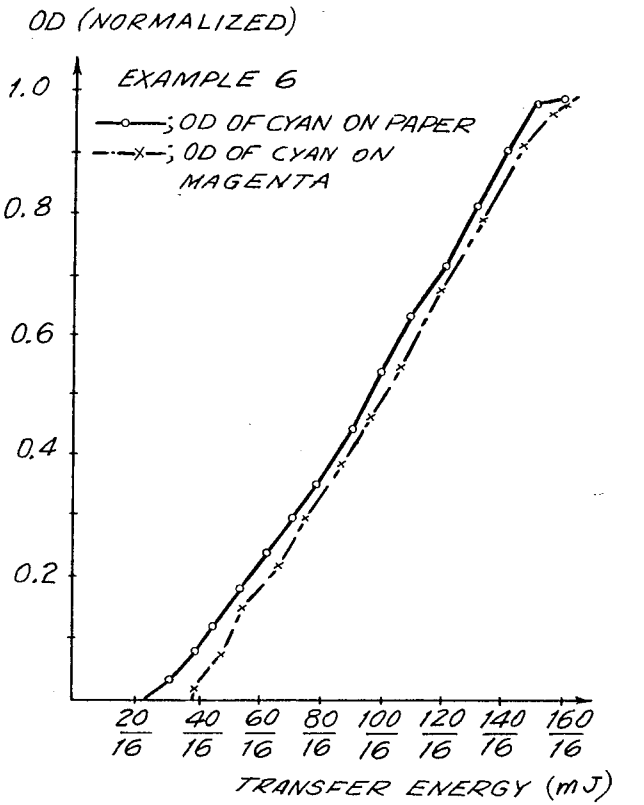
Figure 13:
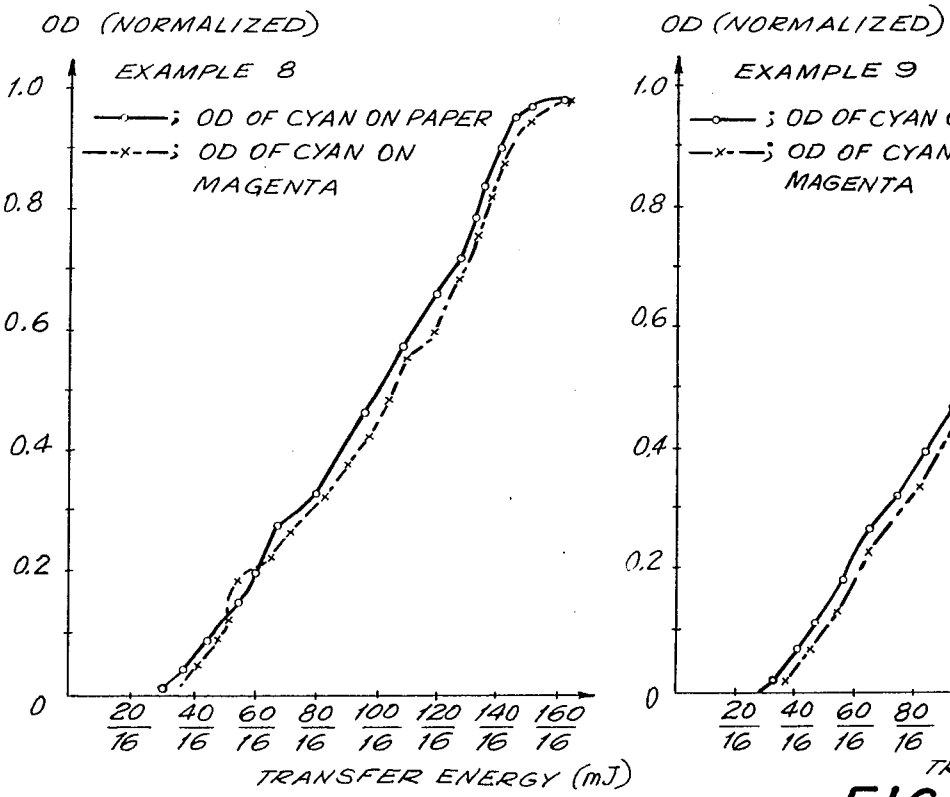
Figure 14:
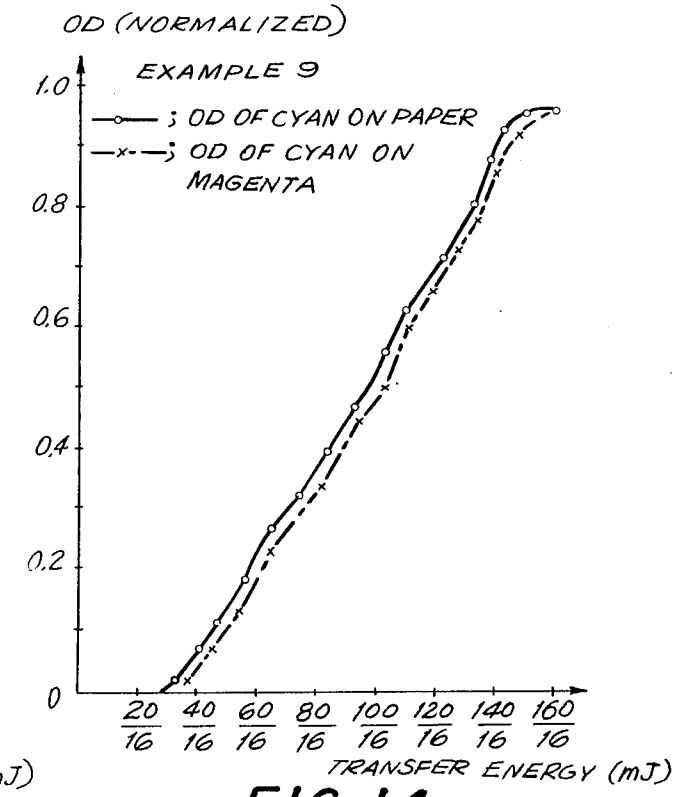
Figure 16:
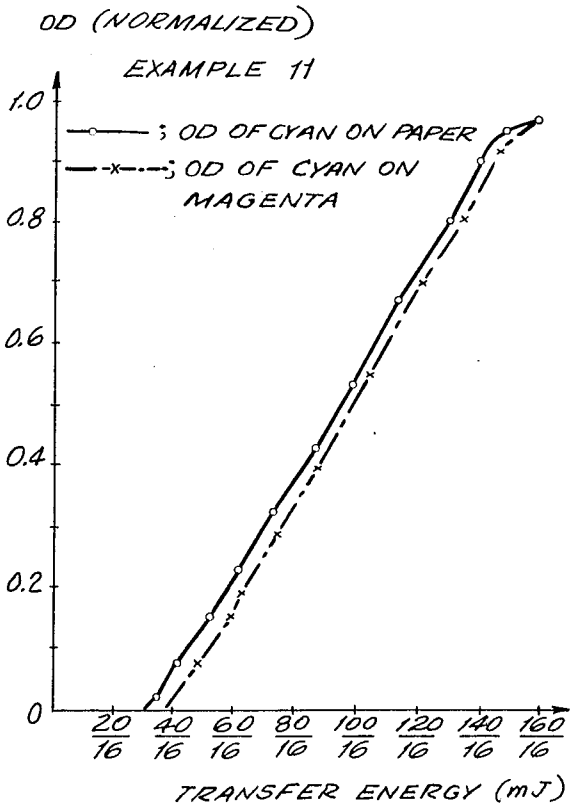
Figure 15:
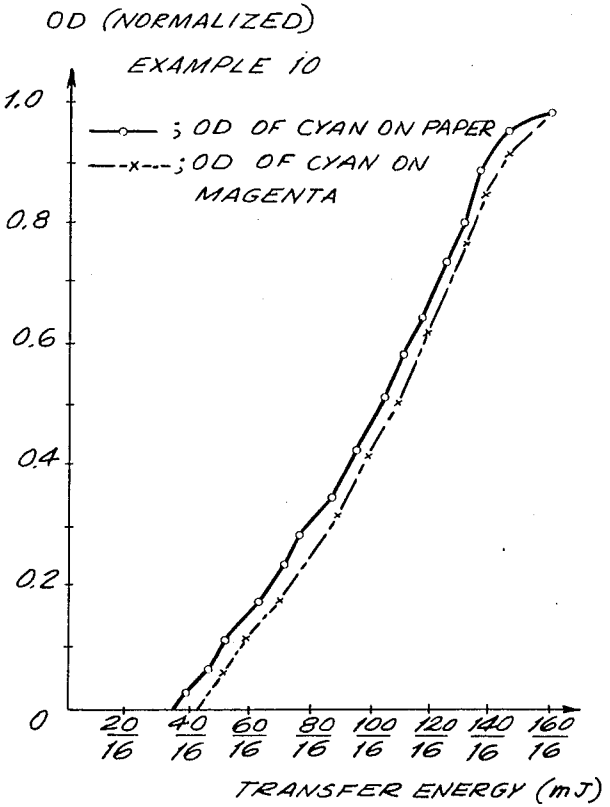
Figure 17:
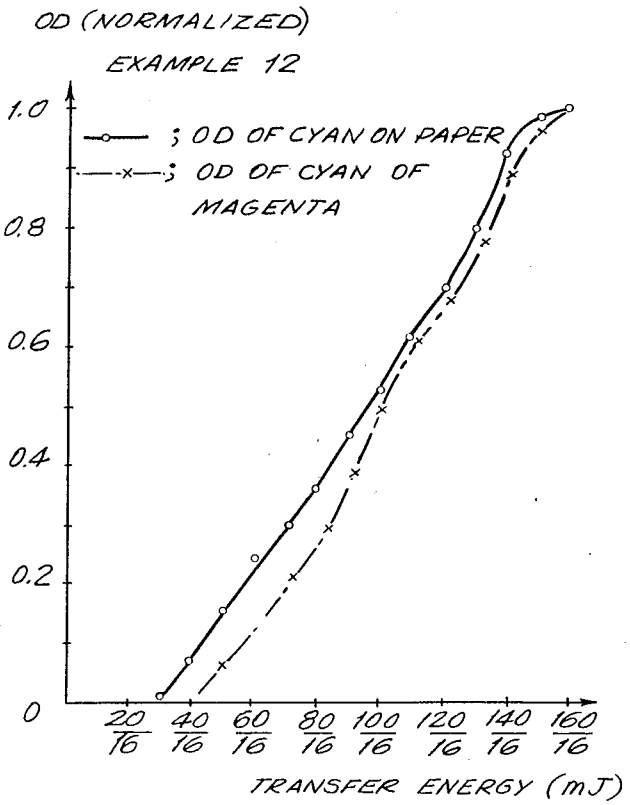
Figure 18:
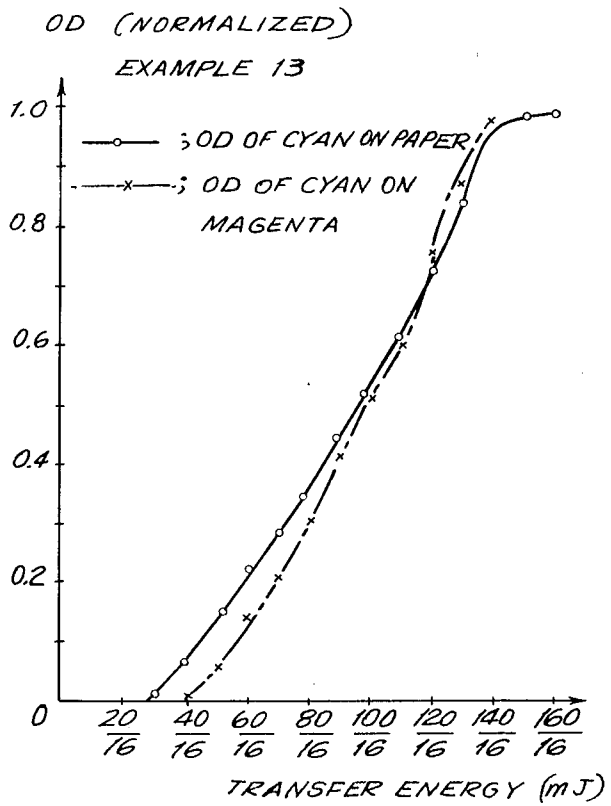
Figure 19:
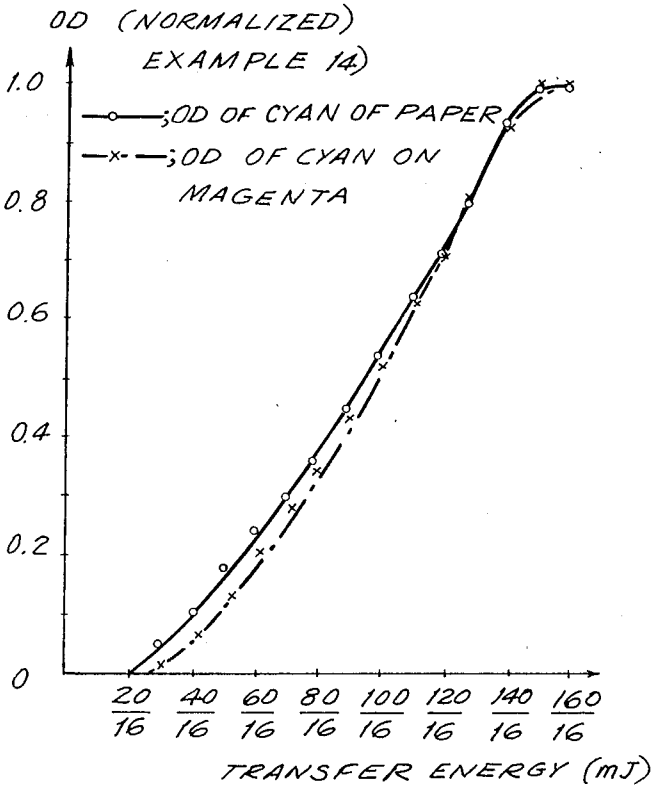
Figure 20:
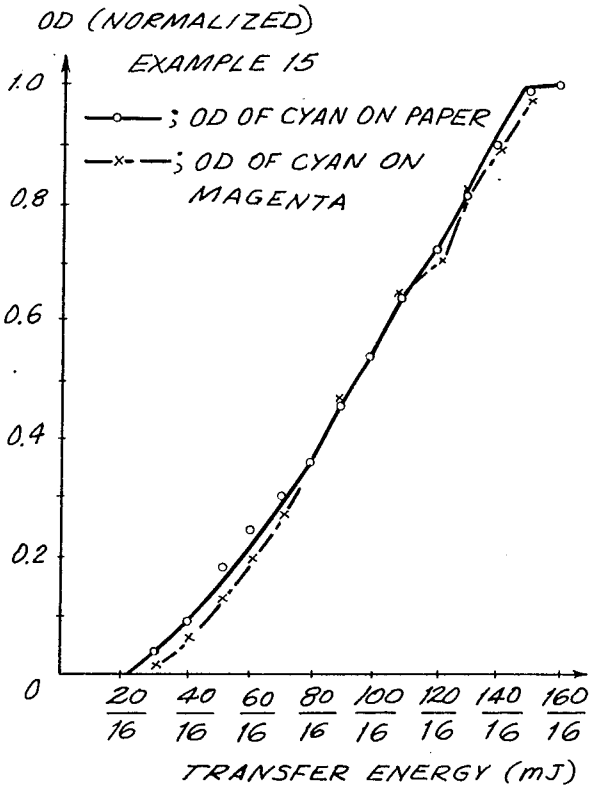
Figure 21:
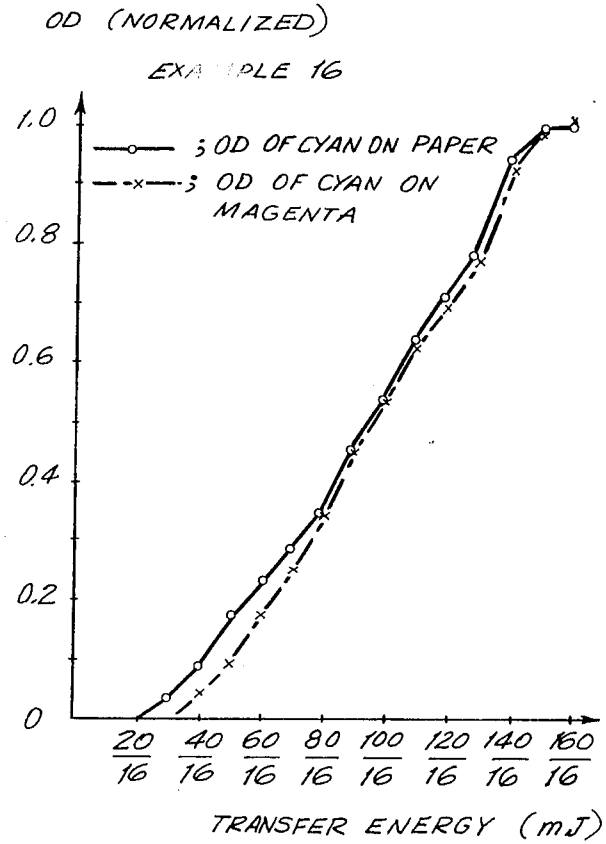
Figure 22:
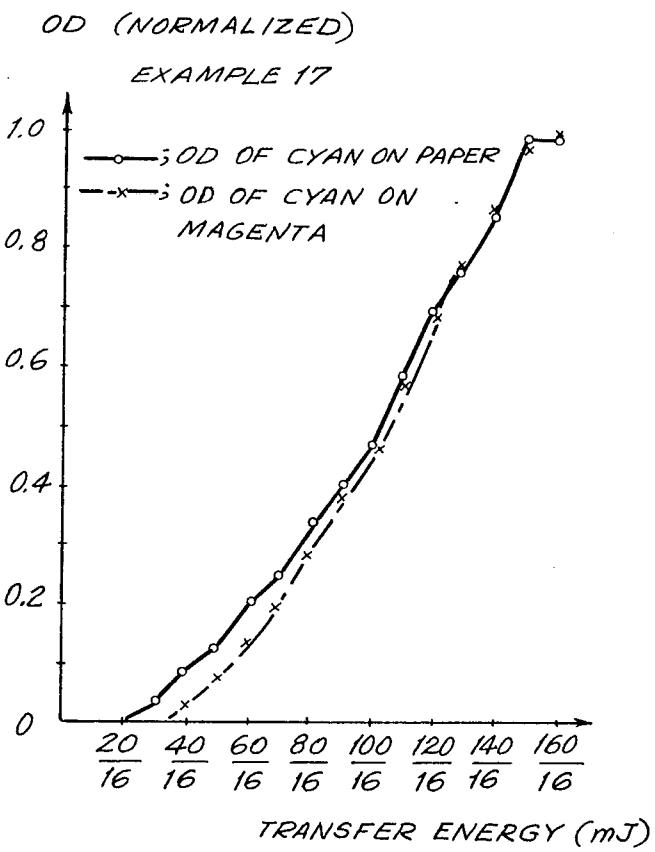
Figure 23:
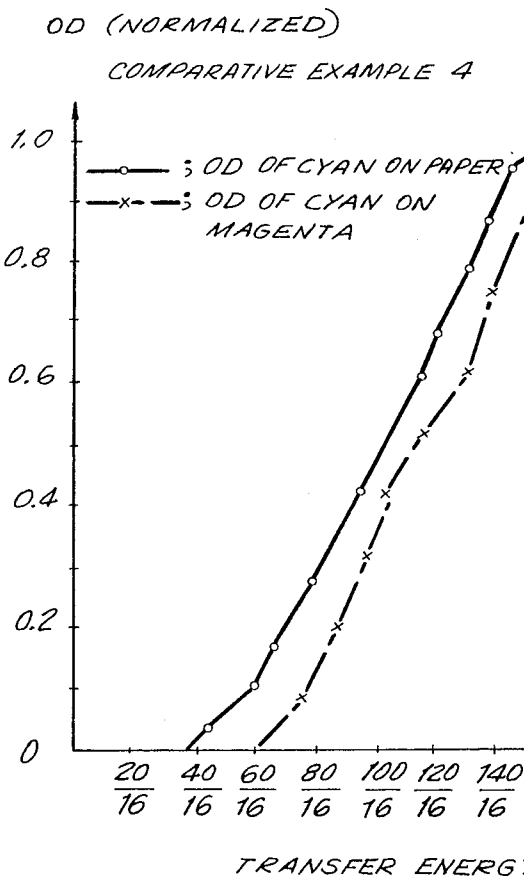
Figure 24:
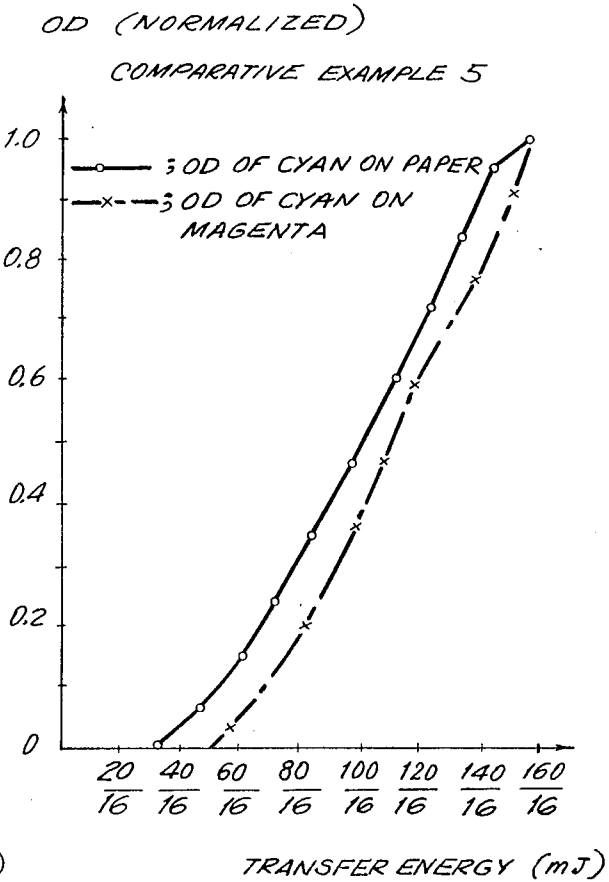
Figure 25:
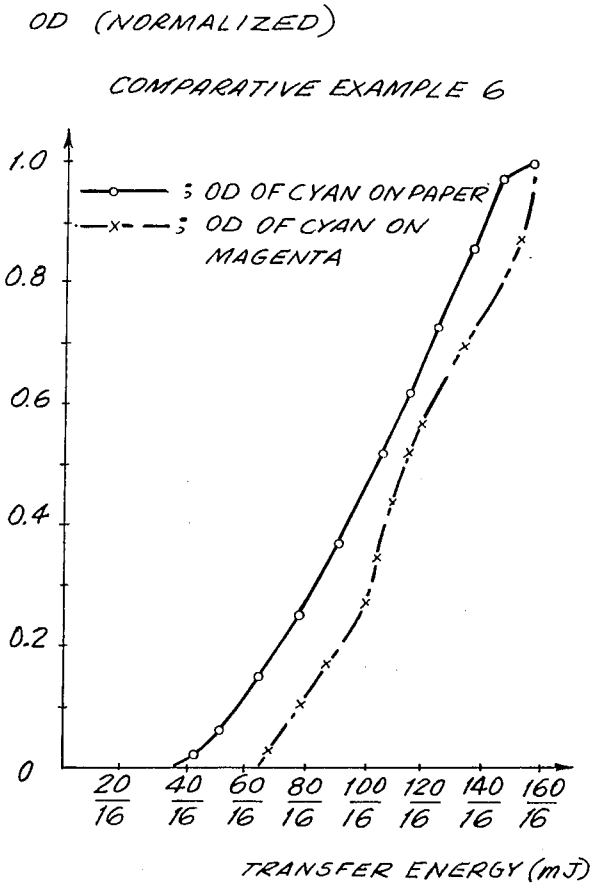
Figure 26:
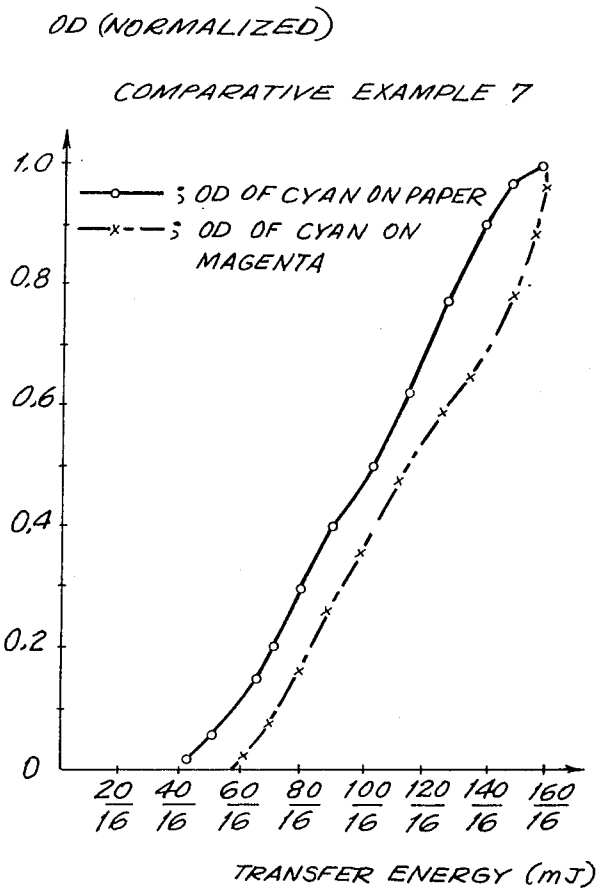
Figure 27:
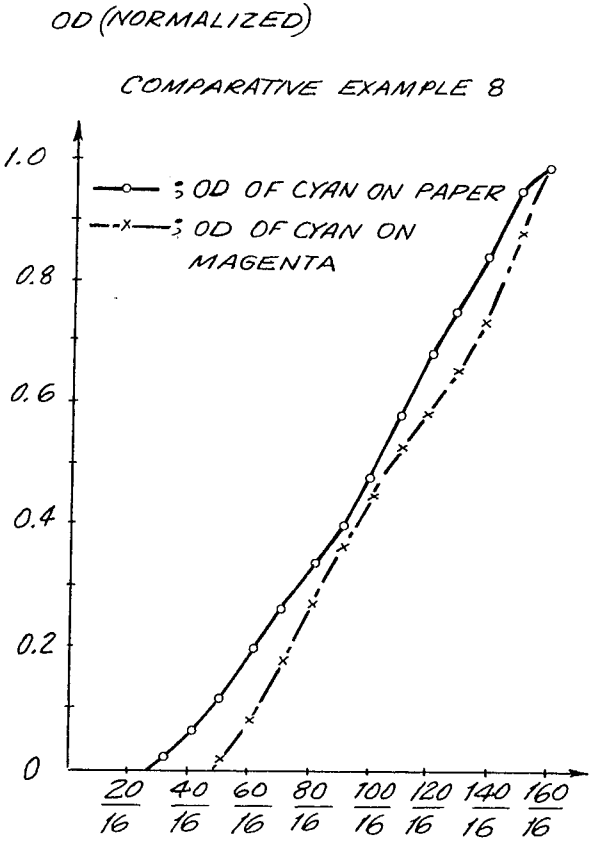
Figure 28:
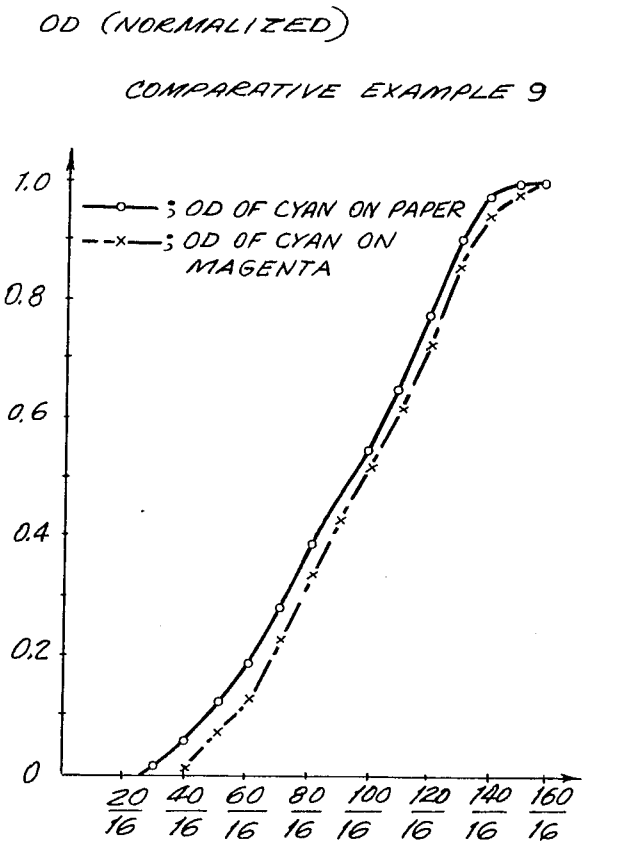
Figure 29:
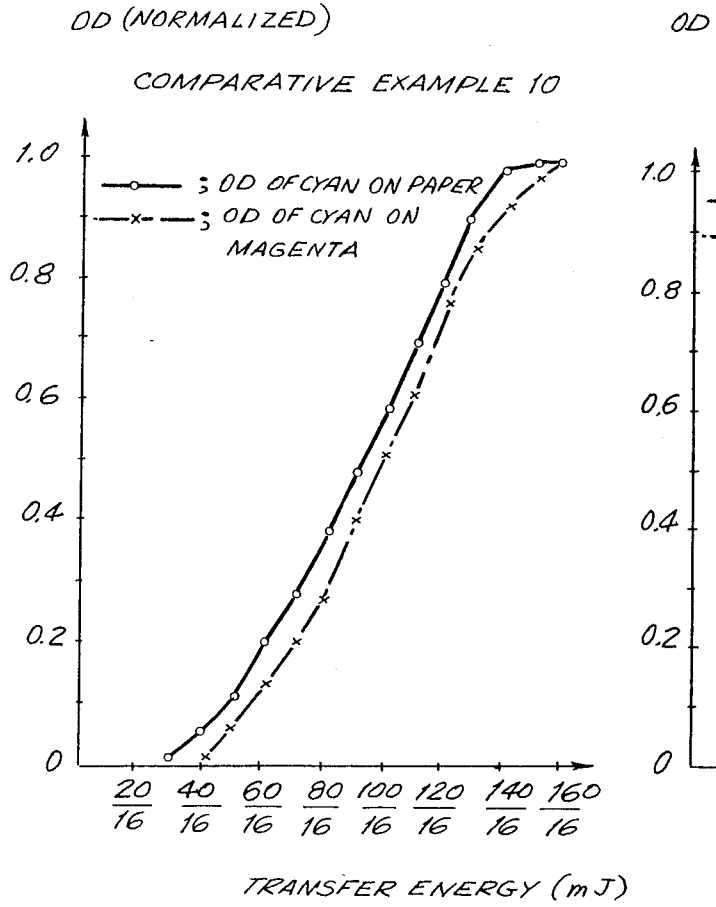

Magenta fusible ink sheets having four layers as shown in FIG. 10 were prepared and examined for anti-blocking and ink superimposing performance. FIG. 10(*a*) is a perspective of a roll of a fusible ink sheet 1001 and FIG. 10(*b*) is a partial exploded view of sheet 1001.

Magenta fusible ink sheet 1001 includes a resistive layer 1002 of 80% by weight of a polyester resin and 20% by weight of conductive carbon black on one side of polyethyleneterephthalate film substrate 1003. A fusible ink layer 1004 is disposed on the opposite surface of substrate 1003 and a top layer 1005 is on ink layer 1004. Fusible ink layer 1004 is 10% carmine 6B (magenta), 20% oxidized paraffin wax, 45% n-paraffin wax, 17% candelilla wax and 8% ethylene vinyl acetate copolymer. Top layer 1005 is 90% carnauba wax and 10% ethylene vinyl acetate copolymer. The ethylene vinyl acetate copolymer has a melt index of 520 and a vinyl acetate content of 27% by weight and was made by Nippon Unicar Company, Ltd.

Cyan fusible ink sheets having the four layer structure as shown in FIG. 10 were also prepared. The cyan fusible ink sheets had the same resistive layer 1002 of 80% polyester resin and 20% conductive carbon black on PET film substrate 1003. Fusible ink layer 1004 was 10% phthalocyanine blue (cyan), 20% oxidized paraffin wax, 45% n-paraffin wax, 17% candelilla wax and 8% ethylene vinyl acetate copolymer. Top layer 1005 was 90% carnauba wax and 10% ethylene vinyl acetate copolymer. For test purposes, the composition of the ethylene vinyl acetate copolymer varied as shown in Table 1. MI is the melt index in grams per 10 minute period and VA is the percentage of the vinyl acetate component of the ethylene vinyl acetate copolymer.

TABLE 1

| | Example | | | | | Comparative Example | | |
|---|---|---|---|---|---|---|---|---|
| | 1 | 2 | 3 | 4 | 5 | 1 | 2 | 3 |
| MI (g/10 min) | 830 | 520 | 420 | 320 | 150 | 2450 | 1100 | 400 |
| VA content (wt %) | 22 | 27 | 21 | 28 | 20 | 25 | 22 | 35 |
| Producer | Nippon Unicar Co., Ltd. | | | | | | | |

The melt index was measured in accordance with ASTM D-1238.

Blocking resistance was evaluated by measuring the resistance of resistance layer 1002 after fusible ink sheet 1002 in roll form as shown in FIG. 10(*a*) was allowed to stand at a predetermined temperature for a predetermined period of time. Blocking is detected by an increase in resistance which takes place when top layer 1005 and/or ink layer 1004 adhere to resistive layer 1002. The resistance of resistive layer 1002 prior to the blocking test was 2 kΩ/ .

Top layer 1005 was examined for anti-blocking properties after standing at 40° C., 50° C. and 60° C. for various predetermined periods. The results are shown in Tables 2-4.

TABLE 2

(standing at 40° C.)

unit: kΩ/□

| | Example | | | | | Comparative Example | | |
|---|---|---|---|---|---|---|---|---|
| | 1 | 2 | 3 | 4 | 5 | 1 | 2 | 3 |
| For 1 day | 2.0 | 2.0 | 2.0 | 2.0 | 2.0 | 2.0 | 2.0 | 2.0 |
| For 5 days | 2.0 | 2.0 | 2.0 | 2.0 | 2.0 | 2.0 | 2.0 | 2.0 |
| For 10 days | 2.0 | 2.0 | 2.0 | 2.0 | 2.0 | 2.0 | 2.0 | 2.0 |
| For 20 days | 2.0 | 2.0 | 2.0 | 2.0 | 2.0 | 6.0 | 2.5 | 2.5 |
| For 30 days | 2.0 | 2.0 | 2.0 | 2.0 | 2.0 | 10.0 | 5.5 | 5.5 |

TABLE 3

(standing at 50° C.)

unit: kΩ/□

| | Example | | | | | Comparative Example | | |
|---|---|---|---|---|---|---|---|---|
| | 1 | 2 | 3 | 4 | 5 | 1 | 2 | 3 |
| For 1 day | 2.0 | 2.0 | 2.0 | 2.0 | 2.0 | 25 | 2.0 | 2.0 |
| For 5 days | 2.0 | 2.0 | 2.0 | 2.0 | 2.0 | >100 | 2.0 | 2.0 |
| For 10 days | 2.0 | 2.0 | 2.0 | 2.0 | 2.0 | >100 | 5.0 | 4.0 |
| For 20 days | 2.0 | 2.0 | 2.0 | 2.0 | 2.0 | >100 | 7.0 | 6.0 |
| For 30 days | 3.5 | 2.0 | 2.0 | 2.0 | 2.0 | >100 | 10.0 | 8.0 |

TABLE 4

(standing at 60° C.)

unit: kΩ/□

| | Example | | | | | Comparative Example | | |
|---|---|---|---|---|---|---|---|---|
| | 1 | 2 | 3 | 4 | 5 | 1 | 2 | 3 |
| For 1 day | 2.0 | 2.0 | 2.0 | 2.0 | 2.0 | 80 | 10 | 3.0 |
| For 5 days | 3.0 | 2.0 | 2.0 | 2.0 | 2.0 | >100 | 25 | 5.0 |
| For 10 days | 5.0 | 3.0 | 2.0 | 2.0 | 2.0 | >100 | 80 | 7.0 |
| For 20 days | 7.0 | 4.0 | 3.0 | 3.0 | 2.0 | >100 | >100 | 10.0 |
| For 30 days | 10.0 | 5.0 | 4.0 | 4.0 | 3.0 | >100 | >100 | 30.0 |

Since the resistance of resistive layer 1002 prior to the blocking test was 2 kΩ/ , it can be seen that top layer 1003 used in Examples 1-5 was significantly better than the top layer 1005 used in Comparative Examples 1–3. The anti-blocking properties of top layer 1005 of 90% carnauba wax and 10% vinyl acetate copolyer improve as both the melt index and the vinyl acetate content of the ethylene vinyl acetate copolymer decreases.

The anti-blocking properties of top player 1005 are good when the amount of ethylene vinyl acetate copolymer is between about 1 and 15% by weight. When less than 1% ethylene vinyl acetate copolymer is used, top layer 1005 cracks as a result of poor flexibility. When more than 15% ethylene vinyl acetate copolymer is used, top layer 1005 develops a new blocking problem as a result of the adhesive properties of the ethylene vinyl acetate copolymer.

It has been determined that the ethylene vinyl acetate copolymer should have a melt index higher than 100 and, more preferably between about 100 and 900. If the melt index is less than about 100, transfer performance is poor as a result of the high melt viscosity of the ink. It has also been determined that the vinyl acetate content of the ethylene vinyl acetate copolymer should be between about 10 and 30%. A fusible ink sheet 1001 having a resistive layer and designed to be used for heat transfer is provided with top layer 1005 in accordance with the present invention, sheet 1001 can be stored without blocking at temperatures of between about 45° C. and 85% relative humidity for a period of one month. When an ordinary fusible ink sheet without a resistive layer is provided with top layer 1005 in accordance with the invention, it can be stored without blocking at temperatures between about 55° C. and 85% relative humidity for one month.

EXAMPLES 6–17 AND COMPARATIVE EXAMPLES 4–11

Top layers for cyan fusible ink sheets having different formulations were prepared in order to improve the superimposing performance without adversely affecting the anti-blocking properties. The compositions of the top layers are shown in Table 5.

TABLE 5 unit: wt %

| | Example No. | | | | | | | | | | | | Comparative Example No. | | | | | | | |
|---|---|---|---|---|---|---|---|---|---|---|---|---|---|---|---|---|---|---|---|---|
| | 6 | 7 | 8 | 9 | 10 | 11 | 12 | 13 | 14 | 15 | 16 | 17 | 4 | 5 | 6 | 7 | 8 | 9 | 10 | 11 |
| Carnauba wax | 85 | 80 | 75 | 70 | 65 | 60 | 85 | 80 | 75 | 70 | 65 | 60 | 87 | 86 | 52 | 45 | 87 | 50 | 45 | 75 |
| Paraffin wax | 5 | 10 | 15 | 20 | 25 | 30 | — | — | — | — | — | — | 3 | 4 | 38 | 45 | — | — | — | — |
| Montan wax | — | — | — | — | — | — | 5 | 10 | 15 | 20 | 25 | 30 | — | — | — | — | 3 | 40 | 45 | — |
| Tackifier | — | — | — | — | — | — | — | — | — | — | — | — | — | — | — | — | — | — | — | 15 |
| EVA | 10 | 10 | 10 | 10 | 10 | 10 | 10 | 10 | 10 | 10 | 10 | 10 | 10 | 10 | 10 | 10 | 10 | 10 | 10 | 10 |

Paraffin wax: A product of Nippon Seiro Co., Ltd. having a DSC single peak at 77.4° C.
Montan wax, oxidized type: A product of Hoechst Co., Ltd. partly saponified, ester-modified wax, having a molecular weight of about 800
EVA: A product of Nippon Unicar Co., Ltd.
Tackifier: A product of Rika-Hercules Co., Ltd. rosin-based, having a melting point of 80° C.

To evaluate the superimposing performance of the ink, magenta ink was transferred to plain paper (TTR made by Mitsubishi Paper Mills, Ltd.) in full density, that is, at an energy level of 160/16 mJ/mm$^2$. Then cyan was transferred onto both the magenta ink and onto plain paper at 16 different densities. The initial density of cyan transfer was 10/16 mJ/mm$^2$ and the densities increased at intervals of 10/16 mJ to full density of 160/16 mJ/mm$^2$. The optical density of the cyan on magenta was compared with the optical density of cyan on plain paper using a Macbeth TR-927 manufactured by Kollmorgan Co., Ltd.

The results of the ink superimposing tests for examples 6–17 and Comparative Examples 4–11 are shown in FIGS. 23–30. The results of Examples 6–17 show that the carnauba wax/ethylene vinyl acetate copolymer system improves the ink's superimposing performance when it is incorporated with a paraffin wax or oxidized montan wax.

Paraffin wax and montan wax produce almost the same effect when incorporated into a top layer. However, their mode of action is entirely different. When paraffin wax is incorporated into the top layer, the compatability of the top layer with the ink layer is improved. This effect permits the ink to be transferred effectively onto previously transferred ink. Oxidized montan wax on the other hand has a multi-distribution of molecular weight as shown by the DSC thermograph of FIG. 9. As a result of this characteristic, the melt viscosity of the ink is gradually lowered as transfer energy increases. Accordingly, the ink is transferred effectively.

The anti-blocking performance of the top layer improves when the incorporated paraffin wax has a single peak in the DSC thermograph. Paraffin wax which undergoes endothermic change as a result of solid/solid phase transition at temperatures below the peak temperature is not effective for improving the anti-blocking properties of the top cover layer.

Oxidized montan wax improves the anti-blocking properties of the top layer by acting synergistically with the carnauba wax. The anti-blocking performance of the top layer is improved most significantly when the montan wax is present in an amount less than about 30 parts by weight of the montan wax/carnauba wax composition. As shown in Comparative Examples 9 and 10, when the amount of montan wax is too high, improvement in ink superimposing performance is shown, but no improvement is shown in the anti-blocking properties.

Figure 30:
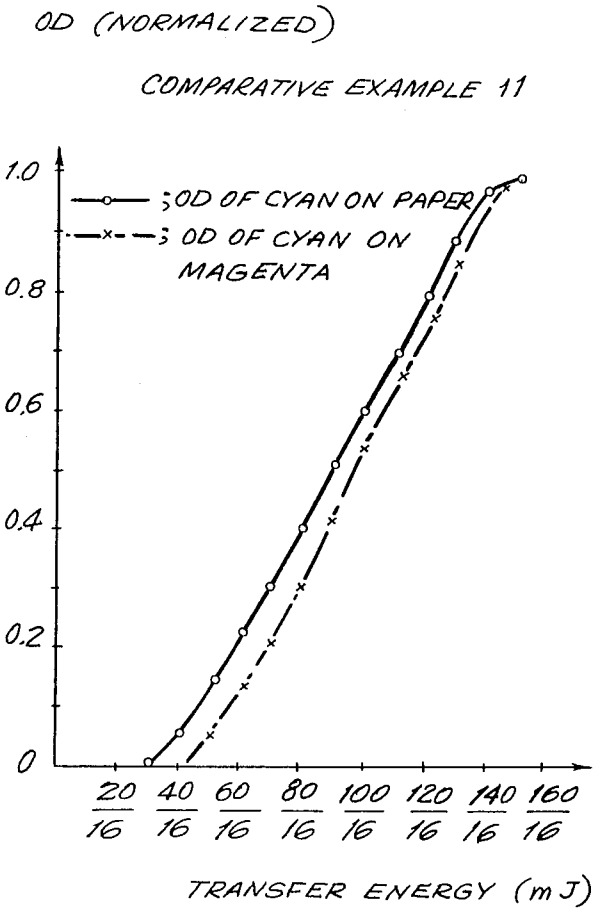
Figure 32:
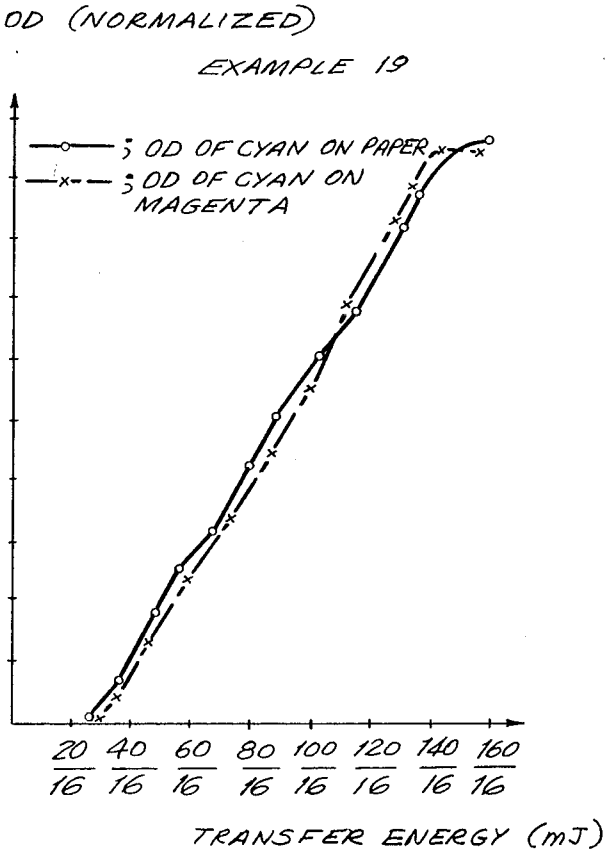
Figure 31:
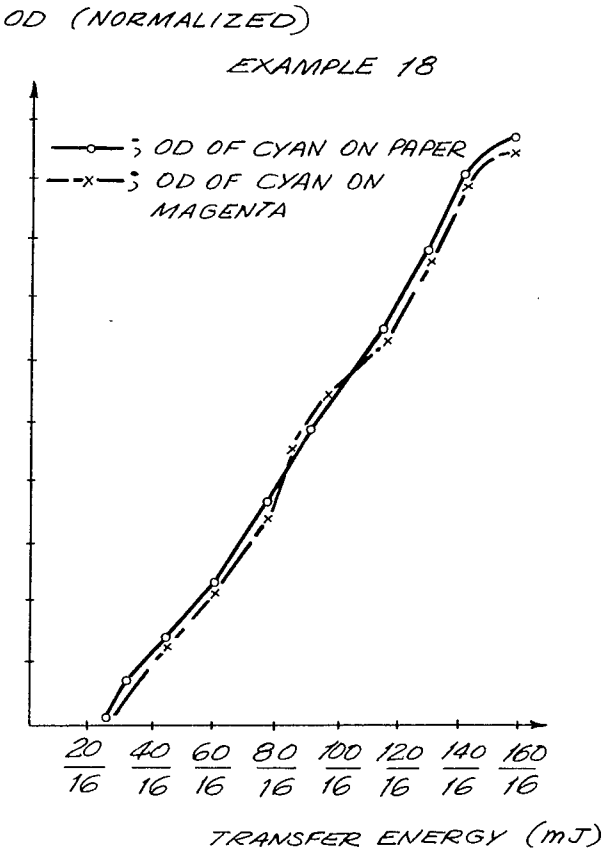
Figure 34:
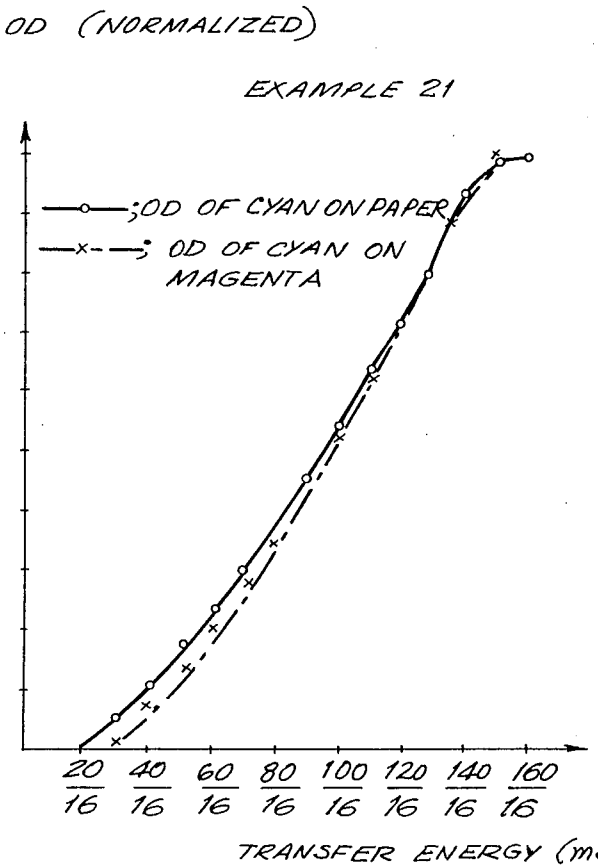
Figure 33:
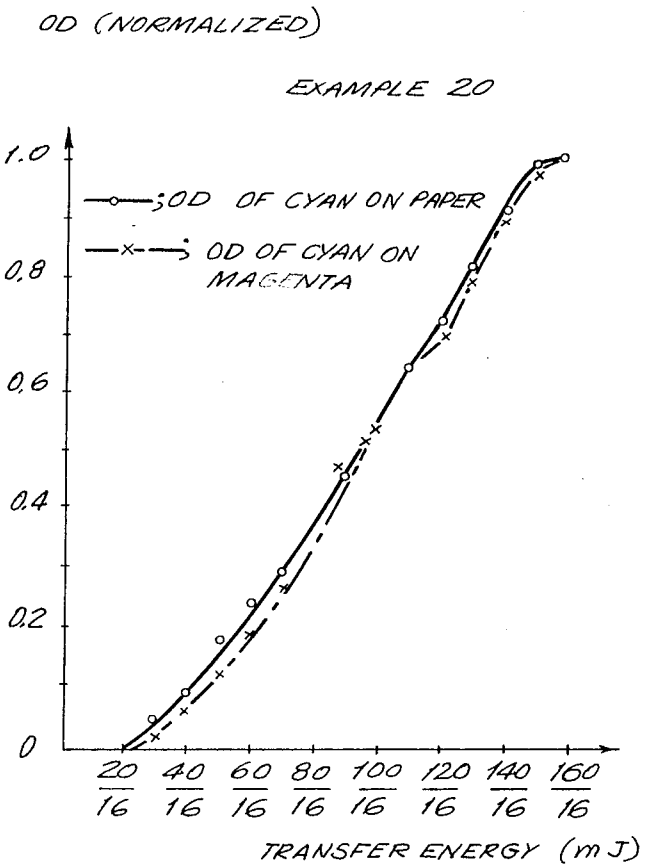

The addition of a tackifier in Comparative Example 11 improves the ink superimposing performance as shown in FIG. 30. However, this effect is due to the tackiness of the tackifier which adversely affects the anti-blocking properties.

EXAMPLES 18–21 AND COMPARATIVE EXAMPLES 12–14

Top layers of carnauba wax, paraffin wax, LMI-EVA and HMI-EVA were prepared according to the formulations shown in Table 6.

TABLE 6 unit: wt %

| | Example | | | | Comparative Example | | |
|---|---|---|---|---|---|---|---|
| | 18 | 19 | 20 | 21 | 12 | 13 | 14 |
| Carnauba wax | 60 | 55 | 50 | 45 | 65 | 40 | 75 |
| Paraffin wax | 20 | 20 | 20 | 20 | 20 | 20 | 20 |

TABLE 6-continued unit: wt %

| | Example | | | | Comparative Example | | |
|---|---|---|---|---|---|---|---|
| | 18 | 19 | 20 | 21 | 12 | 13 | 14 |
| LMI-EVA | 5 | 5 | 5 | 5 | 5 | 5 | 5 |
| HMI-EVA | 15 | 20 | 25 | 30 | 10 | 35 | 0 |

Paraffin wax: A product of Nippon Seiro Co., Ltd. having a DSC single peak at 77.4° C.
LMI-EVA: A product of Nippon Unicar Co., Ltd. having an MI of 520 and containing 27 wt % of vinyl acetate
HMI-EVA: A product of Nippon Unicar Co., Ltd. having an MI of 2500 and containing 19 wt % of winyl acetate As can be seen from the results of these Examples, the anti-blocking properties and ink superimposing performance were better than in Examples 1–17 in which the amount of LMI-EVA was limited to 15 parts by weight of the composition as a result of the high melt viscosity of the LMI-EVA.

In order to achieve better ink transfer, the transfer head pressure was increased to 300 g/cm for the compositions shown in Examples 18–21. The head pressure for Examples 1–17 was 100 g/cm. The results of the transfer tests are shown in FIGS. 31–37, which are graphs showing optical density as a function of transfer energy for the transfer of cyan ink from a fusible ink sheet of the invention onto plain transfer paper and onto magenta ink on transfer paper. As can be seen from these graphs, both the first color (magenta) and the second color (cyan) transferred well over the entire range of optical density.

Figure 35:
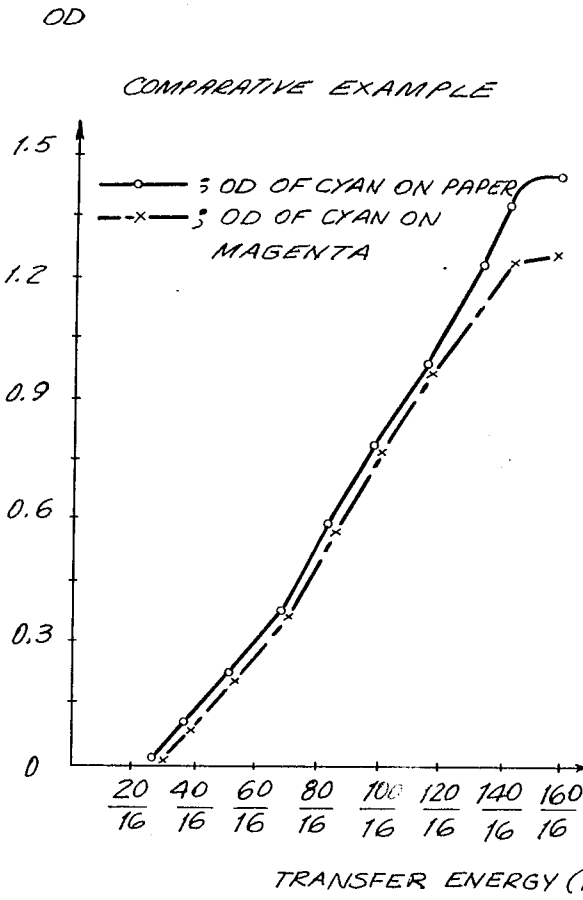
Figure 36:
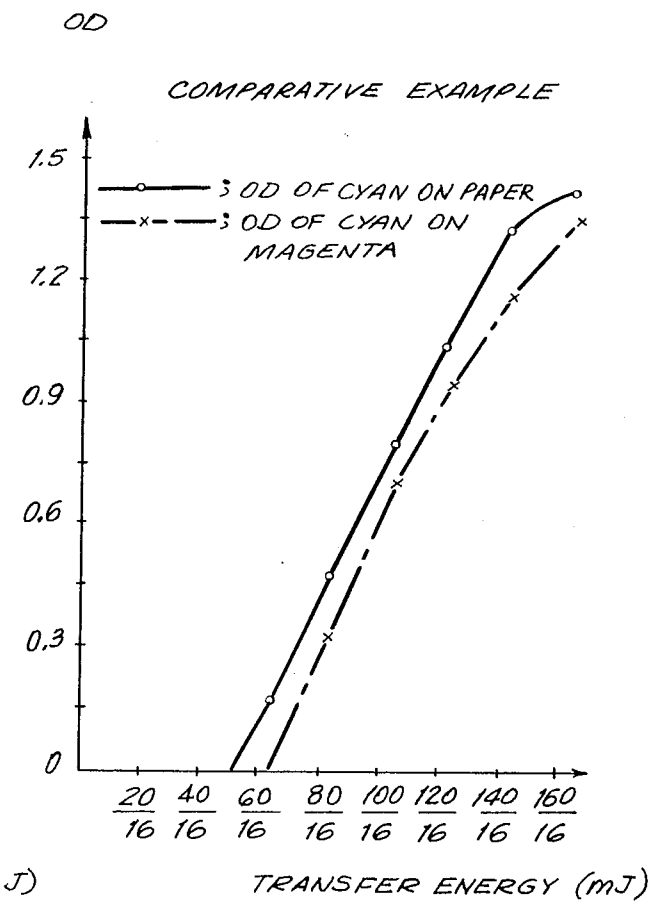
Figure 37:
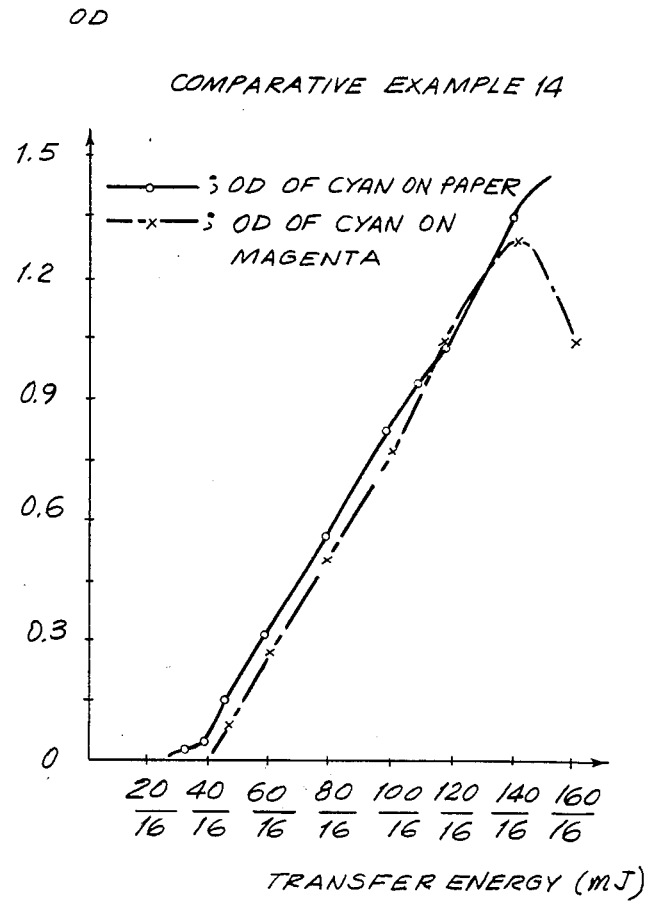

As can be seen in Comparative Example 12, represented by FIG. 35, the optical density of the second color is limited to 1.25. This is due to the fact that the head pressure is high, i.e. 300 g/cm, and the amount of HMI-EVA is so low that the second color (cyan) is repelled by the first color (magenta). The same is true of Comparative Example 14.

HMI-EVA can be incorporated into the top layer in amounts up to about 30 parts by weight because the melt viscosity of the HMI-EVA is much lower than that of the LMI-EVA. A large amount of HMI-EVA is effective in increasing the adhesive strength of the top layer and also in preventing the ink from flowing. These effects make it possible to increase the transfer head pressure and the high transfer head pressure produces good ink superimposing performance over the entire range of optical densities. Furthermore, improved anti-blocking properties were obtained in Examples 18–21.

The fusible ink sheets prepared in accordance with the invention have superior anti-blocking properties and ink superimposing performance as compared to conventional ink transfer sheets. When HMI-EVA is incorporated, which has never been used in conventional ink transfer sheets, the transfer head pressure can be increased. As a result, the ink superimposing preformance improves significantly. The fusible ink sheets of this invention can be used with any type of printer that performs heat transfer using a thermal or an electrothermal head.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A fusible ink sheet for heat transfer printing, comprising:

a substrate;

a heat fusible color layer including an ink dispersed therein, the ink layer disposed on the substrate; and a top layer including between about 85 and 99 parts by weight of carnauba wax, and between about 1 and 15 parts by weight of ethylene vinyl acetate copolymer, the ethylene vinyl acetate copolymer having a melt index between about 100 and 900 and between about 10 and 30% by weight of vinyl acetate, the top layer disposed on the color layer.

2. The fusible ink sheet of claim 1, wherein the ethylene vinyl acetate copolymer is a mixture of low melt index ethylene vinyl acetate copolmer and high melt index ethylene vinyl acetate copolymer.

3. The fusible ink sheet of claim 2, wherein the low melt index ethylene vinyl acetate copolymer has a melt index between about 100 and 900 and contains between about 10 and 30% by weight of vinyl acetate and the high melt index ethylene vinyl acetate copolymer has a melt index between about 1500 and 3000 and the low melt index ethylene vinyl acetate copolymer and the high melt index ethylene vinyl acetate copolymer are used in a weight ratio of about 1:2.

4. A fusible ink sheet for heat transfer printing, comprising:

a substrate;

a heat fusible color layer including an ink dispersed therein, the color layer disposed on the substrate; and a top layer disposed on the color layer, the top layer including between about 60 and 85 parts of weight carnauba wax, between about 1 and 15 parts by weight ethylene vinyl acetate copolymer and between about 5 and 35 parts by weight paraffin wax.

5. The fusible ink sheet of claim 4, wherein the carnauba wax has a melting point between about 78° and 88° C., the ethylene vinyl acetate copolymer has a melt index between about 100 and 900 and contains between about 10 and 30% by weight of vinyl acetate and the paraffin wax has a single endothermic peak due to melting at a temperature between about 65° and 80° C. in the DSC thermograph and has no other endothermic peaks due to solid/solid phase transition at temperatures below the peak temperature.

6. A fusible ink sheet for heat transfer printing, comprising:

a substrate;

a heat fusible color layer including an ink dispersed therein, the color layer disposed on the substrate; and a top layer disposed on the color layer, the top layer including between about 60 and 85 parts by weight carnauba wax, between about 1 and 15 parts by weight ethylene vinyl acetate copolymer and between about 5 and 30 parts by weight of montan wax.

7. The fusible ink sheet of claim 6, wherein the carnauaba wax has a melting point between about 78° and 88° C., the ethylene vinyl acetate copolymer has a melt index between about 100 and 900 and contains between about 10 and 30% by weight of vinyl acetate and the montan wax has a melting point between about 75° and 120° C.

8. A fusible ink sheet for heat transfer printing, comprising:

a substrate;

a heat fusible color layer including an ink dispersed therein, the color layer disposed on the substrate; and a top layer disposed on the color layer, the top layer including between about 40 and 75 parts by weight of carnauba wax, low melt index ethylene vinyl acetate copolymer between about 5 and 30 parts by weight of high melt index ethylene vinyl acetate copolymer and between about 5 and 35 parts by weight of paraffin wax.

9. The fusible ink sheet of claim 8, wherein the carnauba wax has a melting point between about 78° and 88° C., the low melt index ethylene vinyl acetate copolymer has a melt index between about 100 and 900 and contains between about 10 and 30% by weight of vinyl acetate, the high melt index ethylene vinyl acetate copolymer has a melt index between about 1500 and 3000, and the paraffin wax has a single endothermic peak due to melting at a temperature between about 65° and 80° C. in the DSC thermograph and has no other endothermic peaks due to solid/solid phase transition at temperatures below the peak temperature.

10. A fusible ink sheet for heat transfer printing comprising:

a substrate;

a heat fusible color layer including an ink dispersed therein, the color layer disposed on the substrate; and a top layer disposed on the color layer, the top layer formed from between about 85 and 99 parts by weight of carnauba wax having a melting point between about 78° and 88° mixed with between about 1 and 15 parts by weight of ethylene vinyl acetate copolymer having a melt index between about 100 and 900 and containing between about 10 and 30% by weight of vinyl acetate.

11. A fusible ink sheet for heat transfer printing comprising:

a substrate;

a heat fusible color layer including an ink dispersed therein, the color layer disposed on the substrate; and a top layer disposed on the color layer, the top layer formed from between about 60 and 85 parts by weight of carnauba wax having a melting point between about 78° and 88°, between about 5 and 35 parts by weight of paraffin wax having a single endothermic peak due to melting at between about 65° and 80° in the DSC thermograph and having no other endothermic peaks due to solid/solid phase transition at temperatures below the peak temperature and between about 1 and 15 parts by weight of ethylene vinyl acetate copolymer having a melt index between about 100 and 900 and containing between about 10 and 30% by weight of vinyl acetate.

12. A fusible ink sheet for heat transfer printing comprising:

a substrate;

a heat fusible color layer including an ink dispersed therein, the color layer disposed on the substrate; and a top layer disposed on the color layer, the top layer formed from between about 60 and 85 parts by weight of carnauba wax having a melting point between about 78° and 88° C., between about 5 and 30 parts by weight of montan wax having a melting point between about 75° and 120° C. and between about 1 and 15 parts by weight of ethylene vinyl acetate copolymer having a melt index between about 100 and 900 and containing between about 10 and 30% by weight of vinyl acetate.

13. A fusible ink sheet for heat transfer printing comprising:

a substrate;

a heat fusible color layer including an ink therein, the color layer disposed on the substrate; and a top layer disposed on the color layer, the top layer formed from between about 40 and 75 parts by weight of carnauba wax having a melting point between about 78° and 88° C., between about 5 and 35 parts by weight of paraffin wax having a single endothermic peak due to melting between about 65° and 80° C. in the DSC thermograph and having no other endothermic peaks due to solid/solid phase transition at temperatures below the peak temperature, between about 1 and 15 parts by weight of ethylene vinyl acetate copolymer having a melt index between about 100 and 900 and containing 10 and 30% by weight of vinyl acetate and between about 5 and 30 parts by weight of ethylene vinyl acetate copolymer having a melt index between about 1500 and 3000.

* * * * *